US006213623B1

(12) United States Patent
Campman

(10) Patent No.: US 6,213,623 B1
(45) **Date of Patent: *Apr. 10, 2001**

(54) GLOW AND FLASH BATON

(76) Inventor: James P Campman, 329 Bendhill Rd., Fredonia, PA (US) 16124

( * ) Notice: Subject to any disclaimer, the term of this patent is extended or adjusted under 35 U.S.C. 154(b) by 0 days.

This patent is subject to a terminal disclaimer.

(21) Appl. No.: 09/197,569

(22) Filed: Nov. 23, 1998

Related U.S. Application Data

(63) Continuation-in-part of application No. 08/857,169, filed on May 15, 1997, now Pat. No. 5,865,524.

(51) Int. Cl.[7] ..... F21L 4/02
(52) U.S. Cl. ..... 362/202; 362/184; 362/205
(58) Field of Search ..... 362/158, 202, 362/205, 208, 184, 102, 800, 186

(56) References Cited

U.S. PATENT DOCUMENTS 5,036,442 * 7/1991 Brown ..... 362/102
5,070,437 * 12/1991 Roberts, Sr. ..... 362/158
5,079,679 * 1/1992 Chin-Fa ..... 362/800
5,622,423 * 4/1997 Lee ..... 362/102
5,865,524 * 2/1999 Campman ..... 362/184
6,017,140 * 1/2000 Chou ..... 362/800

* cited by examiner

*Primary Examiner*—Y. Quach
(74) *Attorney, Agent, or Firm*—Jacobson, Price, Holman & Stern, PLLC

(57) ABSTRACT

A resilient watertight light baton is disclosed having multi-colored light source and power source mounted therein. The light sources are in electrical communication with the power source via interior electronics and solid state light sources. The exterior walls of the light baton are machined to effectively transmit light from the light source. The baton is extremely easy to use with only one hand and is controlled with a single button. By pressing the button the unit turns on and a steady glow color is emitted. By pushing the button again the color changes. By pressing and holding the button the selected color flashes. Ten colors or more may be selected or caused to flash using this procedure. This type of design is extreme robustness and can withstand extreme depths of submergence, making it useful for deep diving and submergence signaling applications. All interior electronics and solid state light sources are sealed from the outside atmosphere, thus making the glow baton an explosion proof and waterproof design.

6 Claims, 4 Drawing Sheets

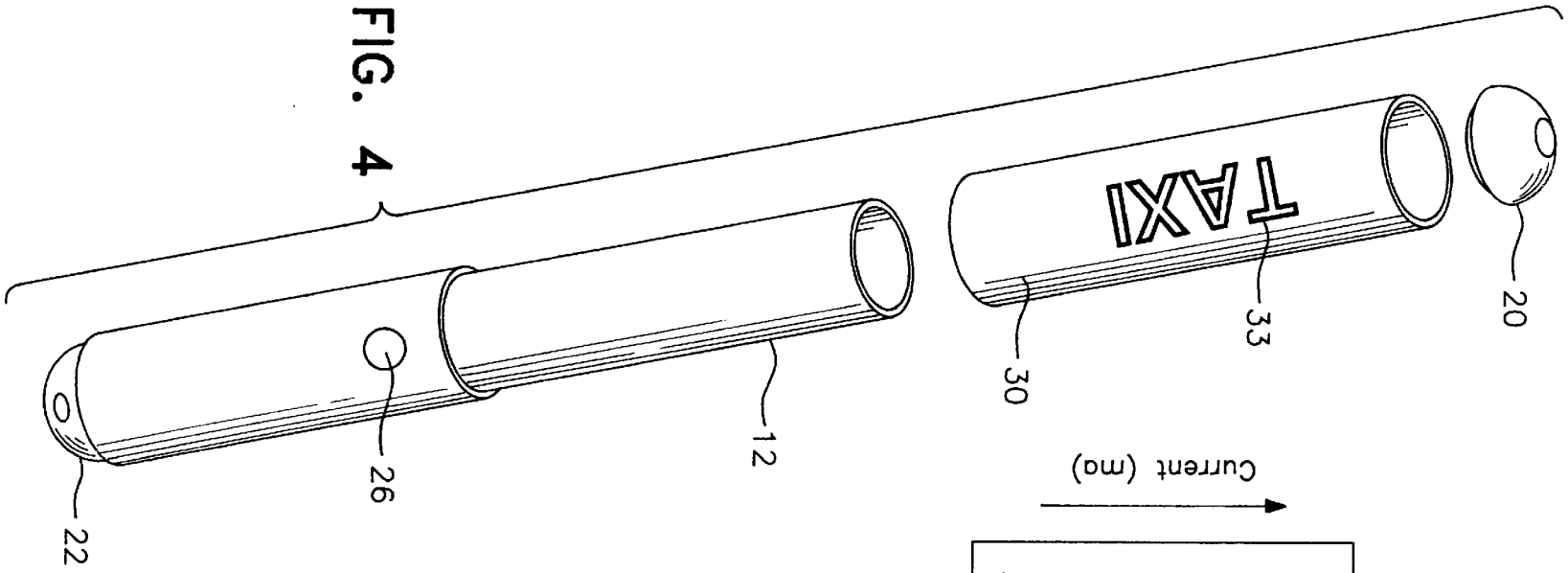
FIG. 4
FIG. 7
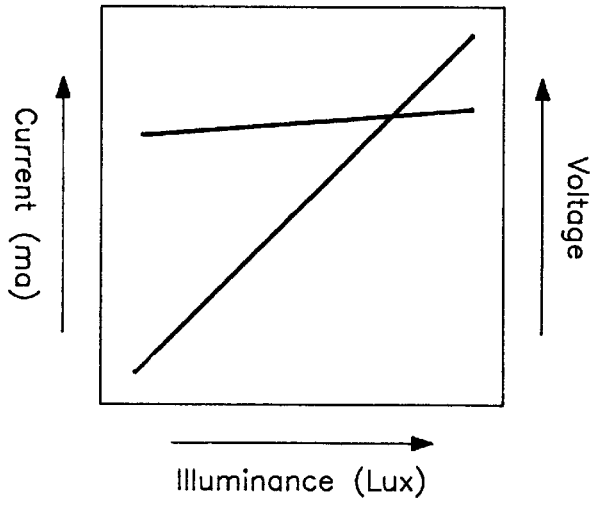
FIG. 6
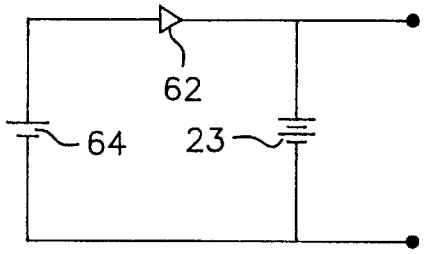

GLOW AND FLASH BATON

CROSS-REFERENCE TO RELATED APPLICATIONS AND PATENTS

This application is a continuation-in-part of application Ser. No. 08/857,169, filed on May 15, 1997, now U.S. Pat. No. 5,865,524, entitled HAND HELD LIGHT WAND FOR VISUAL SIGNALING.

BACKGROUND OF THE INVENTION

Field of the Invention

The invention relates to the field of communication and more particularly to an apparatus for hand held line of sight signaling.

Visual signaling is a common and easily understood method of relaying information from at least one person to another. Visual signaling is often used in environments hostile to other forms of communication. Such environments include traffic intersections, airports, mountain ranges, underwater and the like. Provided the environment is hospitable to the transmission of light from a source point to a receiver point, visual signaling provides an effective means of communication. However, such environments tend to be destructive on the visual signaling device.

One type of visual signaling device is a light baton or wand. Light batons are hand held devices which, at the control of the holder emit colored or white light. Light batons are used to direct pedestrians, motor vehicles, aviation vehicles, and the like. The baton may be used to generate light signals indication safe and clear passage, dangerous and hazardous conditions, direction to proceed, or identifying one's location.

A common problem encountered in use of light batons is the shortened life span of the baton from usage in hostile and rugged environments. These environments expose the baton to manual battering as well as the natural elements. As a result, a need exists for a light baton having characteristics that can withstand use in hostile and rigid environments.

U.S. Pat. No. 5,295,882 to McDermott includes a battery powered device. The device claimed is directed to a spring which supplements the gravitational force to position the device in an erect posture in the water. However, the patent does not teach an audible alarm or different modes with replaceable sleeves.

U.S. Pat. No. 3,016,549 to Finn is directed to an illuminating device with a floating device. The device is in two parts and must be detached from the illuminating portion.

U.S. Pat. No. 5,622,423 to Lee is a traffic control light. It is not waterproof or appear to be submersible in water. The device includes numerous LEDs for illumination.

U.S. Pat. No. 2,364,787 to Harrison et al. is related to a portable flash light carried by a person afloat in water. However, it is a two part system and does not appear submersible.

U.S. Pat. Nos. 2,364,787 to Meyers and 2,908,901 to Lewis each describes an audible alarm.

While these various inventions in the prior art have provided improvements in visual signaling devices, none provides a visual signaling light emitting baton with a choice of different colors either glowing, flashing or a combination thereof.

SUMMARY OF THE INVENTION

The hand held light wand of the present invention is a visual signaling light emitting wand with a choice of different colors either glowing, flashing or a combination thereof. This device is sealed at each end with hemispheric end caps. The present invention provides extreme robustness and is essentially a special case of an egg shape. This shape persists the light wand to withstand extreme depths of submergence, thus making it useful for deep diving signaling applications.

The present invention provides a lightweight all solid state lighting source that easily changes colors by simply pressing one button. The baton is extremely easy to use with only one hand and is controlled with a single button. By pressing the button, to turn the baton on, a steady glow color is activated. Pushing the button again changes the color. Additionally, by pressing and holding the button, the user can cause the baton to flash the selected color. It is contemplated that the baton can have at least ten or more colors selected or caused to flash using this procedure.

The mechanical design of the baton is a tube sealed at both ends with hemispheric end caps. This type of design provides an extreme robustness and the baton can withstand extreme depths of submergence, making it useful for deep diving and submergence signaling applications. All interior electronics and solid state light sources are sealed from the outside atmosphere, thus making the glow baton explosion proof and waterproof.

It is an object of the invention to provide a resilient watertight light baton having a multicolored light source and power source mounted therein.

It is a further object of the invention to provide the light sources in electrical communication with the power source via interior electronics and solid state light sources.

Another object of the invention is to provide machined exterior walls of the light baton to effectively transmit light from the light source.

It is an advantage of the invention that the baton is extremely easy to use with only one hand and is controlled with a single button.

It is an object of the invention to provide a steady glow color of light after a pushing of a button.

It is a further advantage of the invention to be able to select ten or more colors of light and be able to cause flashing of the light.

A further advantage of the invention is that this type of design is extremely robust and can withstand extreme depths of submergence, making it useful for deep diving and submergence signaling applications.

It is a further object of the invention to seal all interior electronics and solid state light sources from the outside atmosphere, thus making the glow baton explosion and waterproof.

Further novel features, advantages and other objects of this invention will become apparent from the following detailed description, discussion and the appended claims taken in conjunction with the accompanying drawings.

BRIEF DESCRIPTION OF THE DRAWINGS

A preferred structural system embodiment and preferred sub components of this invention are disclosed in the accompanying drawings in which:

FIG. 4 is an exploded perspective view of the invention with a visual message sleeve.

FIG. 6 is a simple charging circuit.

FIG. 7 is a current voltage light intensity curve.

DETAILED DESCRIPTION OF THE DRAWINGS

Figure 1:
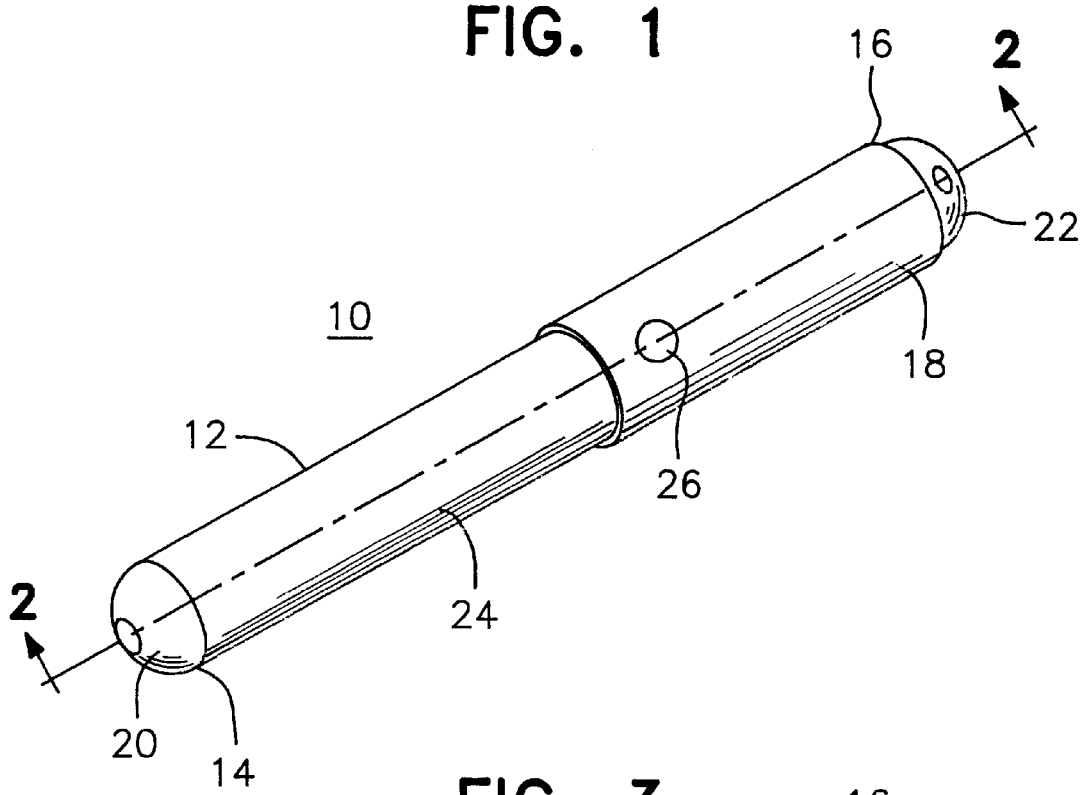
FIG. 1 is a perspective view of a first embodiment of the present invention.

FIG. 1 depicts a perspective view of a first embodiment of the present invention. As shown, the present invention comprises a light baton 10 having an elongated, hollow, tubular body 12. Body 12 includes a contiguous forward portion 14 and rear portion 16 separated by a switch housing 18. Body 12 may be made of plastic, polyethylene or any resilient waterproof material. Forward portion 14 is translucent and may include light dispersing means coated thereon. Light dispersing means. may include crushed prisms, knurled plastics or any other light dispersing means.

A front cap 20 is positioned at and contiguous with a forward distal end of forward portion 14. A back cap 22 is positioned at and contiguous with a rear distal end of rear portion 16.

The light baton 10 measures 13.5 inches long by 1.5 inches in diameter. It weighs a mere 9 ounces. The tubular surface area of body 12 is of a fluted design. The flutes 24 increase the surface area of the baton 10 and result in a more effective light radiation.

The baton 10 is extremely easy to use with only one hand and is controlled with a single button 26. By pressing button 26, the baton 10 activates and glows a steady color. By pushing button 26 again, the color can be changed. When button 26 is pressed and held, the selected color flashes. It is contemplated that ten colors or more may be selected or caused to flash using this procedure. The mechanical design of the baton 10 is a tube sealed at both ends with the hemispheric end caps 20,22. This type of design provides extreme robustness and permits the glow baton 10 to withstand extreme depths of submergence, and thus making it useful for deep diving and submergence signaling applications.

Figure 2:
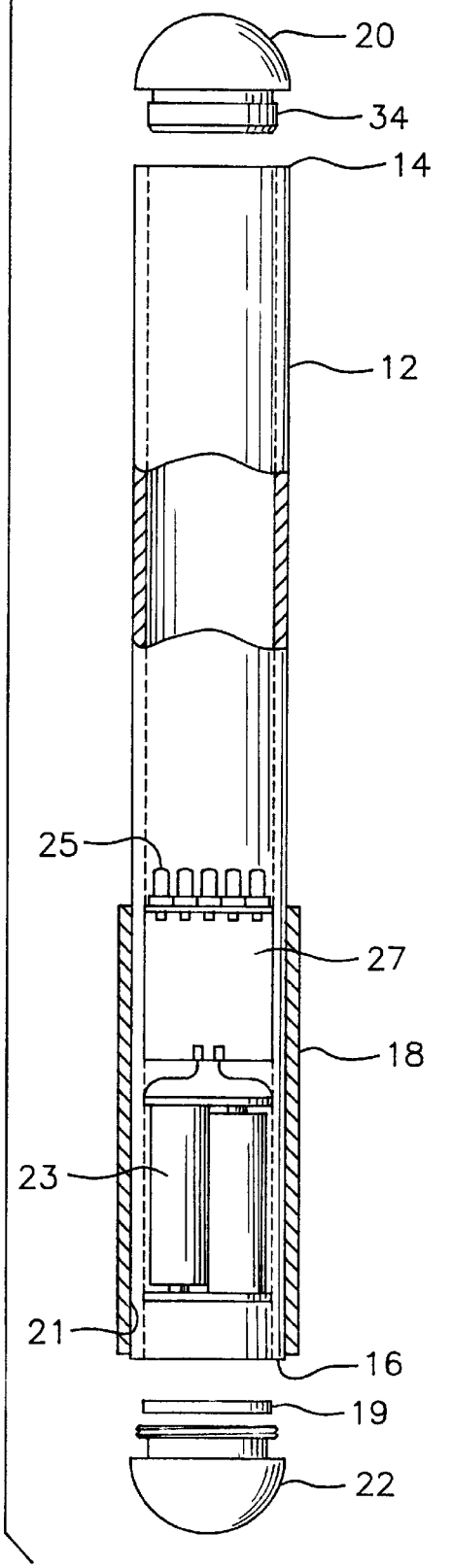
FIG. 2 is a partially exploded cross section along the line II—II of FIG. 1.

FIG. 2 is a partially exploded cross section along the line II—II of FIG. 1. With reference to FIG. 2, located in the baton 10 in the interior cavity of rear portion is a power supply 23. The power supply 23 may be any battery source or electrical power source known by the skilled artisan that provides sufficient electrical operating power, such as alkaline batteries, nickel metal hydrides, etc. In the preferred embodiment, the baton 10 is powered by two AA size alkaline batteries 23. Such rechargeable batteries will provide power for one week of continuous operation in the flash mode. Additionally, solar cells may be used as a charging source. Because the glow baton 10 is made of transparent plastic, solar cells are easily placed inside this waterproof structure and are totally protected from mechanical damage. All interior electronics and solid state light sources are sealed from the outside atmosphere, thus making the glow baton 10 explosion proof and waterproof. The LEDs are generally indicated by numeral 25 and in electrical communication with the power source 23.

The front cap 20 has translucent walls defining a forward hemispheric shape and an elongated hollow tubular portion 34. The tubular portion 34 is in optical communication with the LEDs 25. In addition, the tubular portion 34 has a diameter approximately equal to the internal cavity diameter of the forward portion 14. As a result, front cap 20 is held at the forward distal end of the baton 10 by friction fitting the tubular portion 34 within the internal cavity of the forward portion 14. By this arrangement, the front cap 20 remains in optical communication with the internal cavity of forward portion 14. Front cap 12 may be composed of any suitable resilient water proof material such as plastic or glass.

The lighting element includes a circuit card 27 accommodating transistors, resistors and light means or LEDs 25 arranged in subcircuits on the circuit card 27. The circuit card 27 has a circular shape with approximately the same diameter as the internal diameter of rear portion 16. Circuit card 27 is friction fit within rear portion 16 and pushed forward against the interior walls of the switch housing 18.

The rear distal end of body 10 includes internal threads 21 which communicate with treading on a forward portion of back cap 22. The two threads communicate to secure the forward portion of end cap 22 within the internal cavity of rear portion 16. In addition, positioned about the forward portion of back cap is gasket 19. The gasket 19 is held in place by the securing action of end cap 22 and rear portion 16. The gasket 19 facilitates watertight communication between the end cap 22 and the rear portion 16 of glow baton 10.

Figure 3:
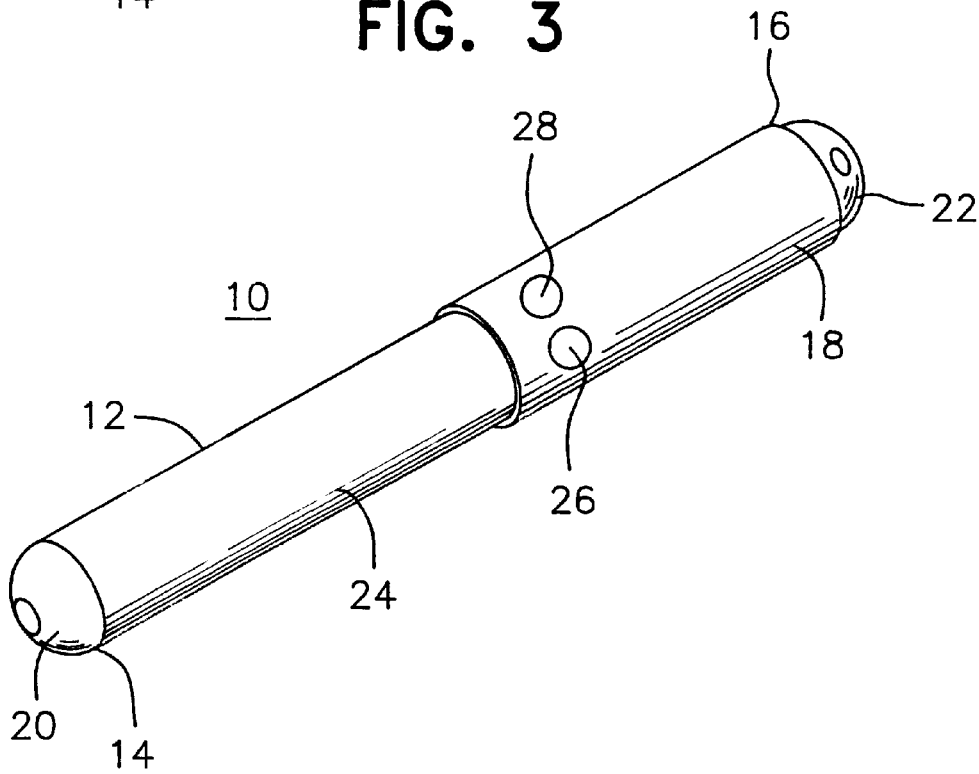
FIG. 3 is a perspective view of a second embodiment of the present invention.

Another embodiment of this invention is shown in FIG. 3. Here, a separate button 28 has been added that activates an internal whistle when pressed. With the ergonomics of such an arrangement, one can easily manipulate the thumb between button 26 and button 28. This arrangement could provide a traffic control policeman with a signaling baton that changes colors and provides an audible attention-getting signal. When the baton 10 is glowing "red" it could signify traffic to stop. When flashing green it could be used to signify for traffic to flow, i.e., analogous to a traffic light signal. Upon each color change, the electronic whistle signal may be sounded by pressing the whistle button 28. This action attracts attention and is analogous to a traffic policeman blowing his whistle and directing traffic flow with his hands.

A third embodiment of this invention is the slip over bright colored lens or transparent tube 30 with a message as depicted in FIG. 4. This lens 30 alters the color emitted by the solid state light source and also permits easy recognition of the baton 10 during the daylight hours when a bright color is readily recognized with an advertising message. The slip over lens 30 or transparent tube can be altered with different colors such as red, green, yellow, or blue. Additionally, words such as "taxi", "police" or even a hotel name can be printed on the transparent tube 30. The baton 10 can be refixed by the insertion of the message carrying lens or tube 30 over the baton 10. It covers the elongated tube 12 such that a doorman can hail a taxi or an usher may use it to announce that seats are available at a public gathering. This message carrying lens or tube 30 may also be used for advertising.

As shown in FIG. 4, the transparent tube 30 with a message "TAXI" 33 can be slipped onto the baton 10 over the elongated hollow tubular body 12. It is contemplated that this arrangement may be used for hailing a taxi. It can be easily seen at night when glowing or flashing. For emergency uses such as with Fire or Police, the baton 10 can simply be placed on the dash of the authorized vehicles, thus announcing arrival of Fire or Police. Of course, different colors and modes of operation are easily selected by the push of a button.

Figure 5:
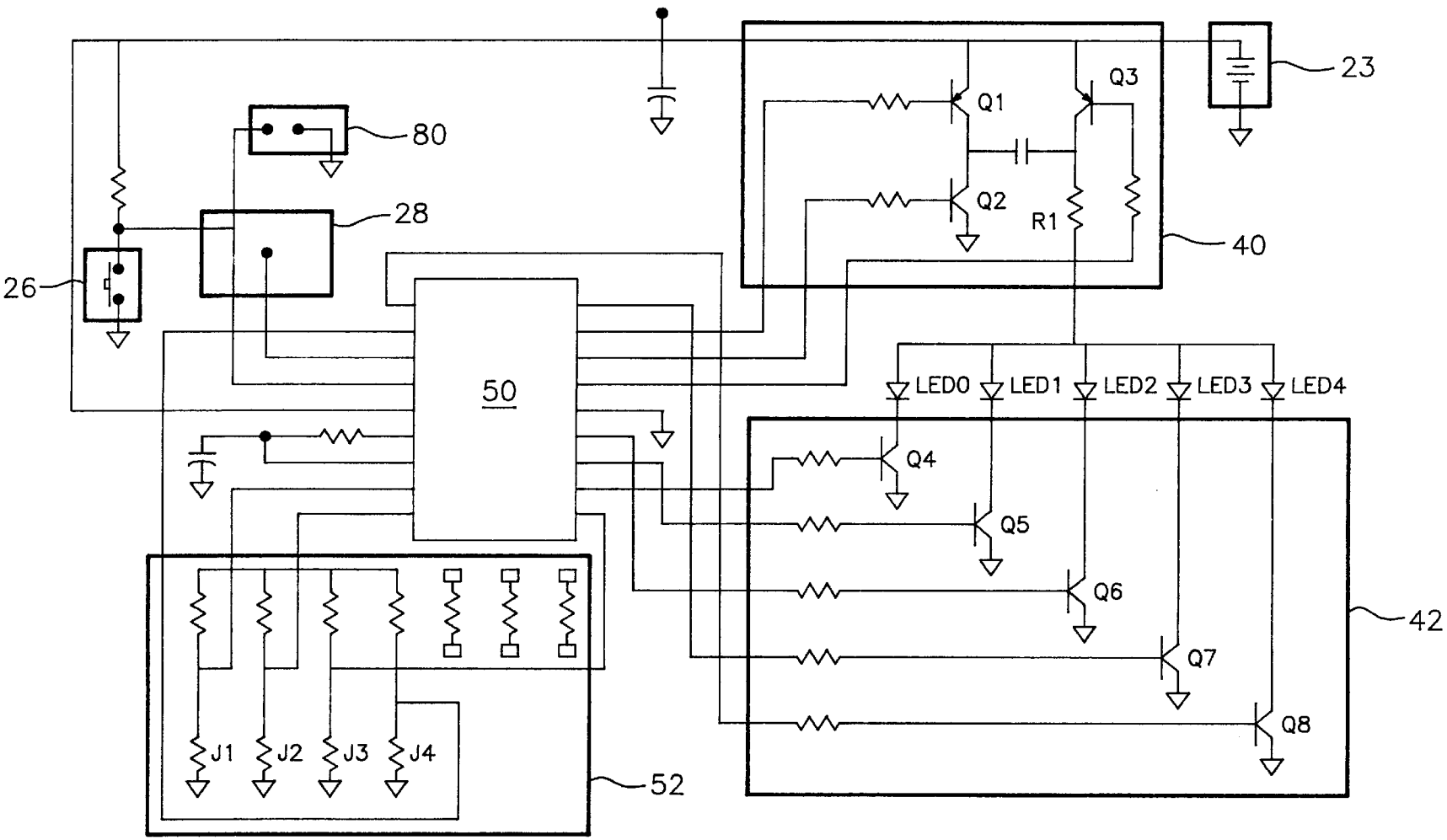
FIG. 5 is a schematic of the electronics and solid state light sources.

FIG. 5 is a schematic drawing of the electronic circuitry. Note that only one control button is required to actuate all four different colors or cause the baton 10 to flash.

Because the blue and green LED colors require a voltage greater than 3 volts to operate effectively, a charge pump circuit configuration 40 is utilized with transistors, Q1, Q2 & Q3 and thousand ohm resistors with a capacitor. A transistor circuit 42 boost the 3 volt supply voltage to 5 volts and is relatively dependent of decaying battery voltage. The transistor circuit 42 includes five transistors Q4, Q5, Q6, Q7 & Q8 and thousand ohm resistors. The charge pump circuit 40 arrangement assures constant LED brightness until the batteries 23 are completely exhausted. Each time the on/off button 26 is depressed the microprocessor 50 will provide a positive going pulse or signal causing the activation of an LED in the LED circuit 25 via the lease of the appropriate transistor from the transistor circuit 42 that causes the LED to activate. Current limiting is provided via the lease R1 connected from the charge pumping circuit 40 to the LED circuit 25. The program jumpers in circuit 52 are arranged to be selectable with the microprocessor 50 such that the baton 10 will glow, flash or operate in a combination thereof. The mode select jumpers are as follows:

J1, J2, J3, 1—Color, Glow & Flash LED0

J1, 2—Color, Glow only, LED0, LED1

No Jumpers, 3—Color, Glow Only

J2, J3, 2—Color, Glow & Flash

J1, J3, 3—Color, Glow & Flash

J3, 4—Color, Glow & Flash

J4, 5—Color, Glow Only

J3, J4, 5—Color Glow & Flash

J1, J2, Buoy Lite, 1—Color, Glow Only

J2, Buoy Lite, 1—Color, Flash Only

A simple charging circuit 40 is shown in FIG. 6, along with a current voltage light intensity curve, FIG. 7. The charging circuit includes a blocking diode 62 and a capacitor 64. When charging two Ni-Cd batteries, the circuitry is as illustrated. In the case of charging 600 mAh Ni-Cd batteries with the AM-5605, the voltage and current at each illuminance are as shown in the figure. The charge current increases or decreases depending on the illuminance, while the charge voltage hardly changes.

Figure 8:
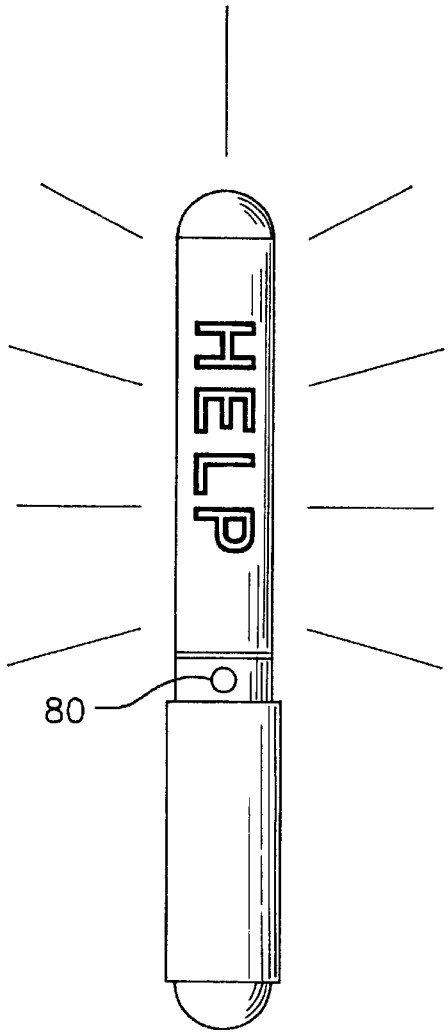
FIG. 8 is a view of a third embodiment of the present invention.

With reference to FIG. 8, by arranging the program jumpers in circuit 52, the glow baton 10 becomes a water activated light. The water activated baton-buoy light 80 serves as an emergency distress signal for boaters and sea rescue and sea rescue operations. The color that is selected and whether the unit is flashing or not flashing is useful as identification information. The baton is weighted such that the center of gravity maintains the unit in an upright position.

While a specific embodiment has been illustrated and described, numerous modifications are possible without departing from the spirit of the invention, and the scope of protection is only limited by the scope of the accompanying claims.

What is claimed is:

1. A hand held illuminating device for visual signaling, comprising:

a tubular body having a hollow interior and including a switch housing; a lighting element and an audible alarm, accommodated within said hollow interior of said tubular body and, said lighting element including at least one switch means and at least one light means electrically connected to said switch means; a power source positioned within said hollow interior of said tubular body, said power source electrically connected to said lighting element for providing power to said lighting element; said tubular body further includes a contiguous forward portion and rearward portion, said forward portion including a forward distal opening communicating with said hollow interior of said tubular body, and said rearward portion includes a rear distal opening communicating with said hollow interior of said tubular body; a front cap having surfaces defining a forward hemispheric shape and a rear hollow elongated tubular portion, said front cap being translucent for dispersing light from said lighting element, said rear hollow elongated tubular portion of said translucent front cap accommodated within said forward distal opening of said forward portion, said translucent front cap cooperating with said rear hollow elongated tubular portion for directing some of said emitted light from within said hollow interior of said tubular body out said forward distal opening and said device further includes a rear cap having a forward hollow elongated tubular shape and a rear hemispheric shape, a gasket having an annular shape, said tubular shape of said rear cap and gasket are accommodated within said rear distal opening of said rearward portion; and at least two buttons connected to said switch housing and electrically connected to said switch means, said power source, said audible alarm and said lighting element, one of said at least two buttons for controlling said lighting element for permitting power to flow from said power source to said light means and for causing said light means to emit light in said lighting element, and one of said at least two buttons for controlling the audible alarm.

2. The hand held illuminating device according to claim 1, wherein said device comprising:

a slip over transparent tube capable of being positioned over said hand held device.

3. The hand held illuminating device according to claim 1, wherein said one of said at least two buttons controlling a number of modes including an off mode, a glow mode, and a flash mode.

4. The hand held illuminating device according to claim 3, wherein said controlling modes of said one of at least two buttons positioned on said switch housing and in electrical communication with said power source and lighting element including an on/off operation.

5. The hand held illuminating device according to claim 4, wherein said hand held illuminating device being submersible for deep sea diving; and said tubular body is of fluted design.

6. The hand held illuminating device according to claim 5, wherein said device comprising:

electronics and said light means comprising LEDs positioned in said tubular body and said electronics including a microprocessor.

* * * * *